US007488877B2

(12) United States Patent
Cheng et al.

(10) Patent No.: US 7,488,877 B2
(45) Date of Patent: Feb. 10, 2009

(54) VIOLIN SHOULDER REST

(76) Inventors: David K. Cheng, 1831 Tanager Dr., Costa Mesa, CA (US) 92626; Diana C. Liu, 1831 Tanager Dr., Costa Mesa, CA (US) 92626

( * ) Notice: Subject to any disclaimer, the term of this patent is extended or adjusted under 35 U.S.C. 154(b) by 74 days.

(21) Appl. No.: 11/676,297

(22) Filed: Feb. 18, 2007

(65) Prior Publication Data

US 2008/0196570 A1 Aug. 21, 2008

(51) Int. Cl.
*G10D 1/02* (2006.01)

(52) U.S. Cl. ..... 84/280; 84/278

(58) Field of Classification Search ..... 84/280, 84/278, 279; D17/20

See application file for complete search history.

(56) References Cited

U.S. PATENT DOCUMENTS

D406,269 S * 3/1999 Mach ..... D17/20

7,265,284 B2 * 9/2007 Muir et al. ..... 84/279

* cited by examiner

*Primary Examiner*—Walter Benson
*Assistant Examiner*—Jianchun Qin
(74) *Attorney, Agent, or Firm*—B K K T; John D. Tran

(57) ABSTRACT

An adjustable and collapsible shoulder rest for a violin or like instrument that has an elongated single piece body with a first and second end being vertically extended at both ends by vertical guards which protect and prevent injury to the user when attempting to collapse the left and right gripping members. Vertical guards may be positioned at a fixed tilted angle to improve and train users to apply proper playing posture. Left and right gripping members have flexible separated gripping appendages that increase the surface area gripping of the instrument body and reduce or negate completely, any unwanted movement or slippage of the instrument body. Left and right gripping members are securely attached to left and right collapsible inserts by stems.

7 Claims, 10 Drawing Sheets

VIOLIN SHOULDER REST

BACKGROUND OF INVENTION

The present invention relates to the shoulder rest for violins, violas or the like instruments. Shoulder rests for violins and the like instruments are used to provide comfortability and stability while a player holds and plays the instrument. While many shoulder rests are on the market, the types that allow the shoulder rest to be folded or collapsible while retaining adjustability and firmness are most popular because of the ability of these types of shoulder rests to conserve storage space in an instrument case.

However, many adjustable and collapsible shoulder rests involve numerous moving parts including a variety of pins, bolts, screws, and other moving parts that increase the chance of malfunction and breakage. Additionally, many current adjustable and collapsible shoulder rests leave the pivot or collapsible area open and unprotected, which results in potential injury to the fingers of the user. Prior patents showing such rests include: U.S. Pat. Nos. 5,731,531; 5,419,226; 5,270,474; 5,567,893; 6,031,163; and 6,291,750.

Further, many prior art have proposed clamp ends or gripping ends in the form of a "U-Shaped" configuration, as described in U.S. Pat. No. 5,419,226 above. However, the U-Shaped clamping ends have smaller contact surface to the instrument body edge, thus creating less friction force to clamp securely to the shoulder rest without slipping.

While these devices may be suitable for the particular purpose to which they address, they are not suitable for incorporating the advantages of a fully adjustable and collapsible shoulder rest that has fewer moving parts to reduce malfunction and breakage and vertical guards that protect and prevent the user's fingers from being pinched or caught within the pivot or collapsible areas of the shoulder rest.

In these respects, the shoulder rest according to the present invention substantially departs from the conventional concepts and designs of the prior art, and in so doing provides an adjustable and collapsible shoulder rest that is not anticipated, rendered obvious, suggested, or even implied by any of the prior art shoulder rests, either alone or in combination thereof

SUMMARY OF THE INVENTION

In view of the foregoing disadvantages inherent in the known types of adjustable and collapsible shoulder rests now present in the prior art, the general purpose of the present invention, which will be described subsequently in greater detail, is to provide a shoulder rest which allows more desirable kind of adjustability and collapsibility than is provided in the patented constructions described above. Further, the present invention achieves the desired characteristics using fewer parts than required in the above designs described above. Indeed, the present invention's construction does not require screws, bolts, pins or nuts.

Another objective of the present invention is to provide vertical guards to protect and prevent injury to the user's fingers when folding or collapsing the end parts of the shoulder rest.

Another objective of the present invention is to provide several gripping members that have a plurality of separated gripping appendages that improve each gripping member's ability to apply pressure in multiple regions, namely, applying pressure from the directions left, right, middle and top and bottom of the general region of the instrument body being gripped.

Another objective of the present invention is to provide improved flexible clamping or gripping ends which have increased contact surface that conforms to the instrument body edge so as to reduce the chance of unwanted instrument body slippage.

To attain this, the present invention generally comprises an elongated single piece body having a top surface and an undersurface. The undersurface may be comprised of a variety of material, including elastomeric pads or cloth. The elongated single piece body has a first end and a second end and has an undersurface that typically is in the material of an elastomeric pad. The elongated single piece body extending vertically on the first end to create a first vertical guard and extending vertically on the second end to create a second vertical guard. Both vertical guards may be positioned in a desired fixed tilted angle to promote good user posture. In typical use, the vertical guard protects and prevents the user's fingers from being pinched or caught in the pivot or collapsible areas of the shoulder rest. A first collapsible insert is secured to the first vertical guard by a plurality of pivot points and the second collapsible insert is secured to the second vertical guard by another set of plurality of pivot points. The plurality of pivot points allow the collapsible inserts to be folded and collapsed inward and generally parallel to the elongated single piece body. Such plurality of pivot points may be attached to either the sides of the collapsible inserts or in the interior of the vertical guards, or potentially both. The present invention further includes universal gripping members comprising of a plurality of separated gripping appendages. The separated gripping appendages reduces the chance of unwanted movement by the instrument body by increasing the amount of surface area contact on the sides, top and bottom of the general region on the instrument body being gripped. The universal gripping members are connected to both collapsible inserts by a plurality of stems, which may be threaded to allow vertical adjustability. The collapsible inserts being capable of containing a plurality of positioning holes that provide the ability for horizontal adjustability of the gripping members.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

To accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
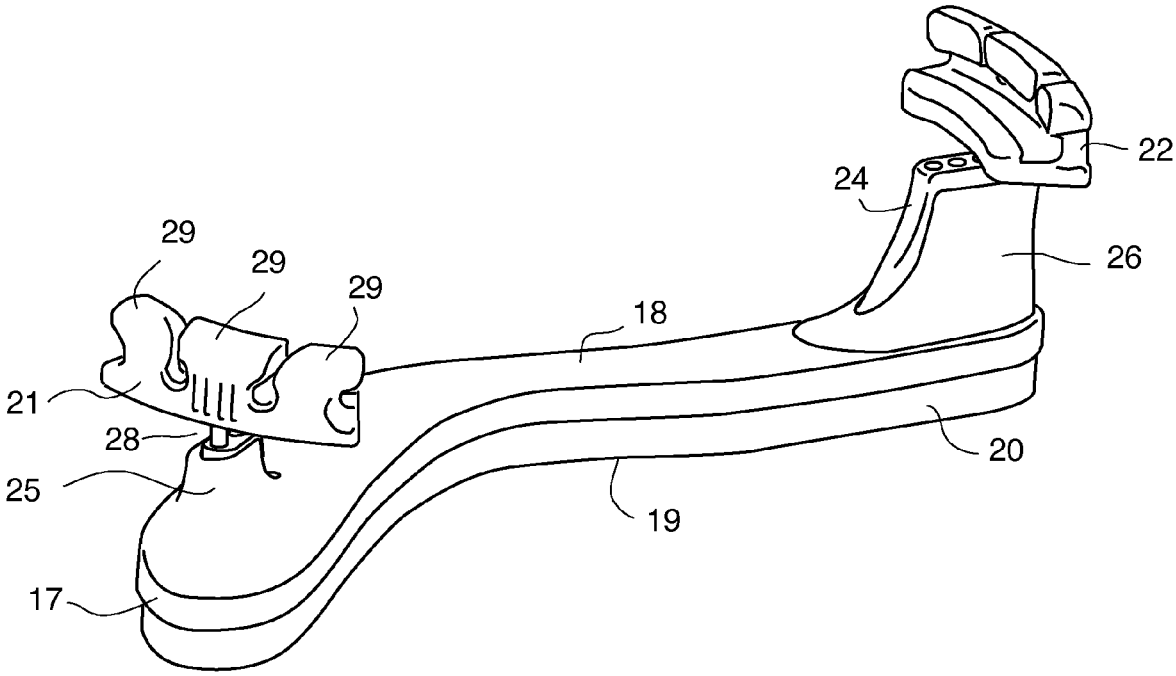
FIG. 1 is a perspective view of the shoulder rest showing both gripping members in an un-collapsed state.

Turning now to the embodiment of FIGS. 1-11, the shoulder rest of the present invention comprises an elongated single piece body 17 with a top surface 18 and a bottom surface 19. In the present embodiment, the bottom surface is comprised of an elastomeric pad 20 for comfortability when placed upon the shoulder of the user. In addition, the elastomeric pad 20 reduces and minimizes unwanted slippage of the shoulder rest from the shoulder of the user. However, it is possible that the bottom surface be comprised of other material such as cloth, which would achieve the same desired result as an elastomeric pad. In the present embodiment, the elongated single piece body 17 is made to conform to the shoulder of the user of the violin. Typically the single piece body is made from a sturdy and rigid material such as plastic or wood. The left gripping member 21 and second gripping member 22 are connected to the left collapsible insert 23 and right collapsible insert 24, respectively, by stems 28.

Figure 2:
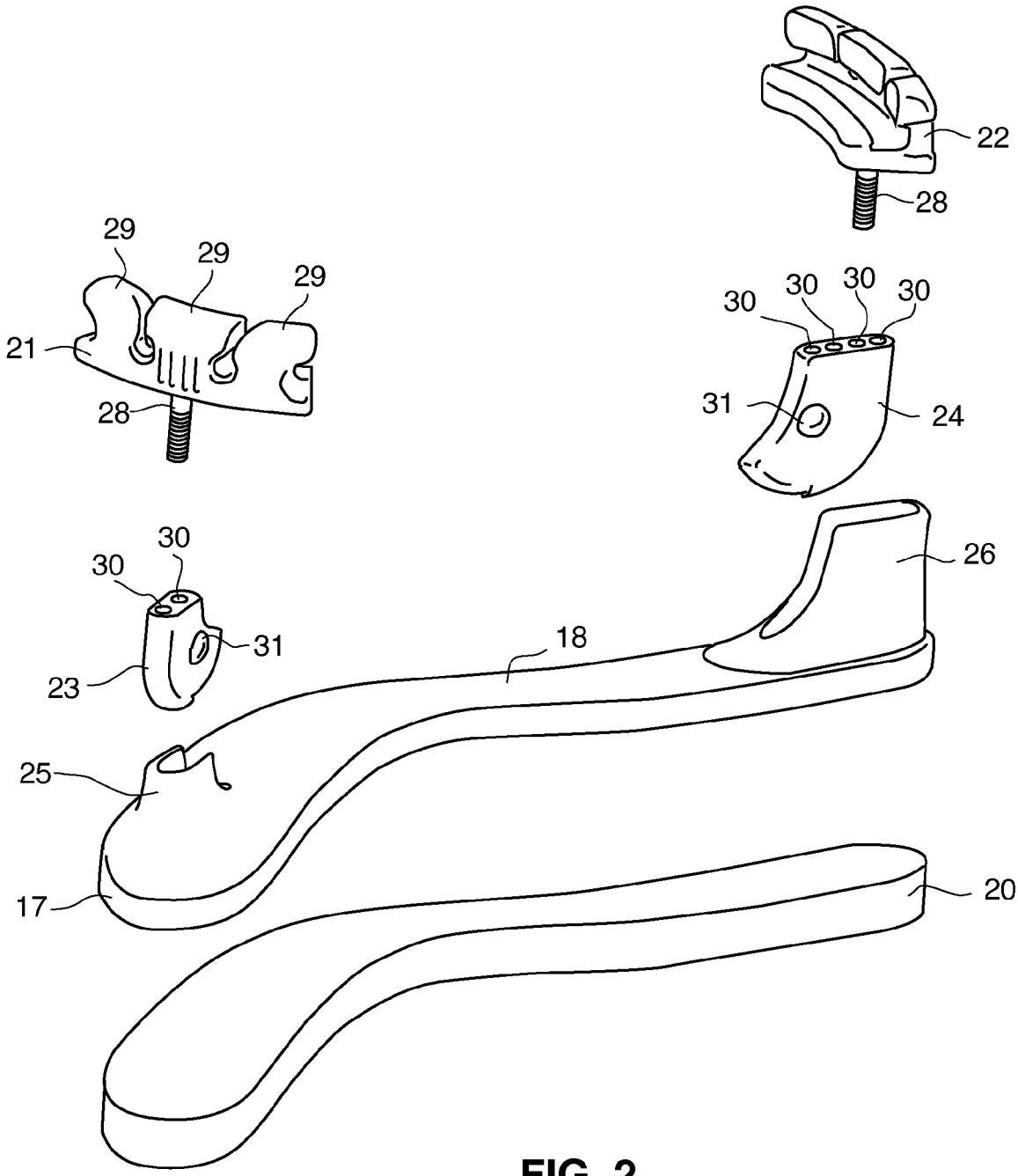
FIG. 2 is an exploded view of the shoulder rest showing both gripping members in an un-collapsed state.

As shown in the FIG. 2, the left collapsible insert 23 is connected to the left vertical guard 25 by at least one pivot point or protuberances, 31 and the right collapsible insert 24 is connected to the right vertical guard by at least one pivot point or protuberance 31. The interior walls of the left and right vertical guards 25 and 26, having a small recess to accept said pivot points. In the present embodiment, at least one pivot point or protuberance 31 is attached to the left and right collapsible inserts 23 and 24. However, it is understood that at least one pivot point 31 could be potentially displaced along a variety of areas on the sides of the respective left and right collapsible inserts 23 and 24, without affecting the functionality of the present invention. In addition, at least one pivot point or protuberance 31 may instead be placed in the interior walls of the left and right vertical guards 25 and 26 with the left and right collapsible inserts 23 and 24 having a recess to accept each of the pivot points or protuberances 31.

Figure 3:
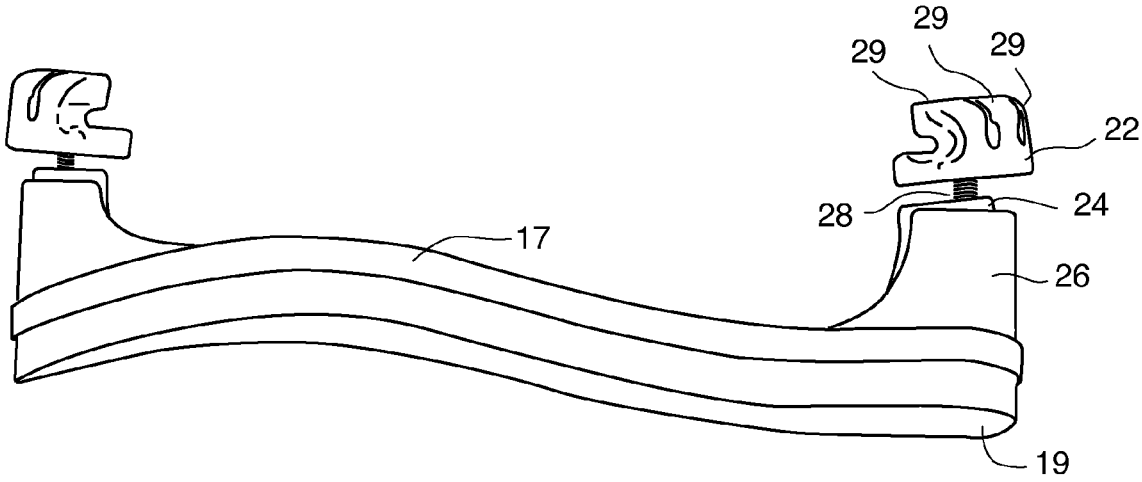
FIG. 3 is a right side view of the shoulder rest.
Figure 4:
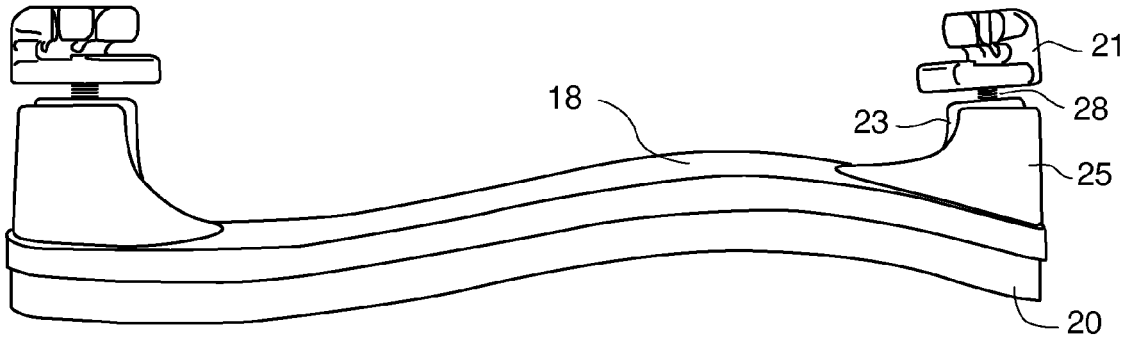
FIG. 4 is a left side view of the shoulder rest.

The left and right vertical guards 25 and 26 extending vertically in a fixed tilt angle on the left and right ends of the elongated single piece body and being part of the elongated single piece body injection mould 17, thus minimizing any need for additional parts and increasing the strength and durability of the shoulder rest. As shown in FIG. 2, the stems 28 may be inserted into a plurality of positioning holes 30 which allow the user to horizontally adjust the location of the left and right gripping members 21 and 22. It should be noted that horizontal adjustment of the gripping members 21 and 22, can also be achieved by other similarly configured structures. For example, the stem 28 can be securely attached to the left and right vertical guards 25 and 26, and receivable within a plurality of positioning holes, 30, located on the bottom side of the gripping members 21 and 22. FIGS. 3 and 4 depict the shoulder rest in its open or un-collapsed state.

Figure 5:
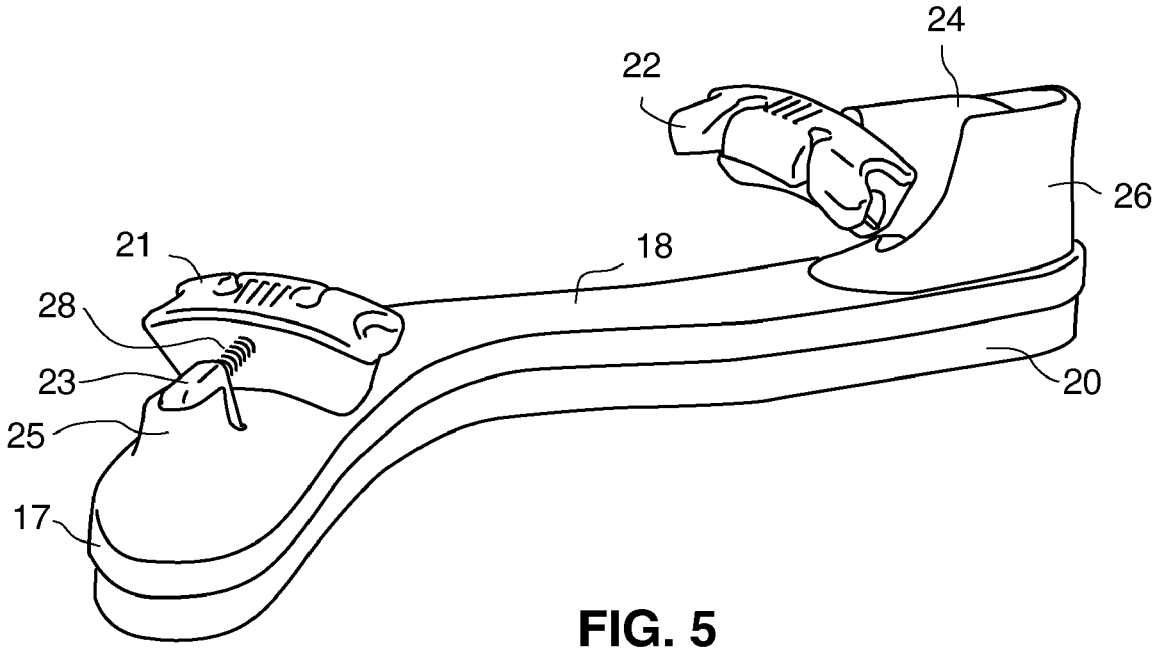
FIG. 5 is a perspective view of the shoulder rest showing both gripping members in a collapsed state.
Figure 6:
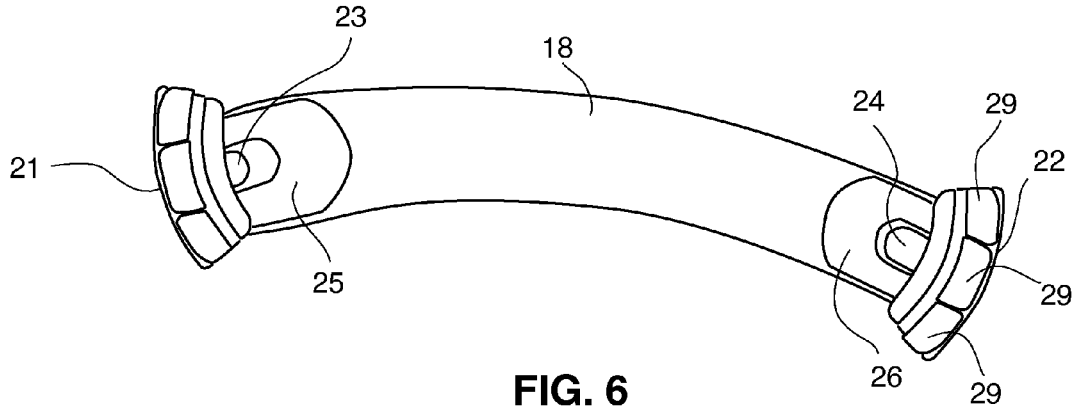
FIG. 6 is a top down perspective view of the shoulder rest.
Figure 7:
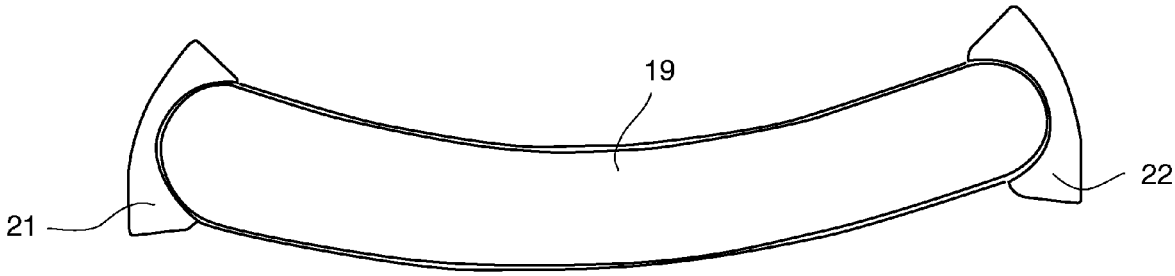
FIG. 7 is a bottom perspective view of the shoulder rest.
Figure 8:
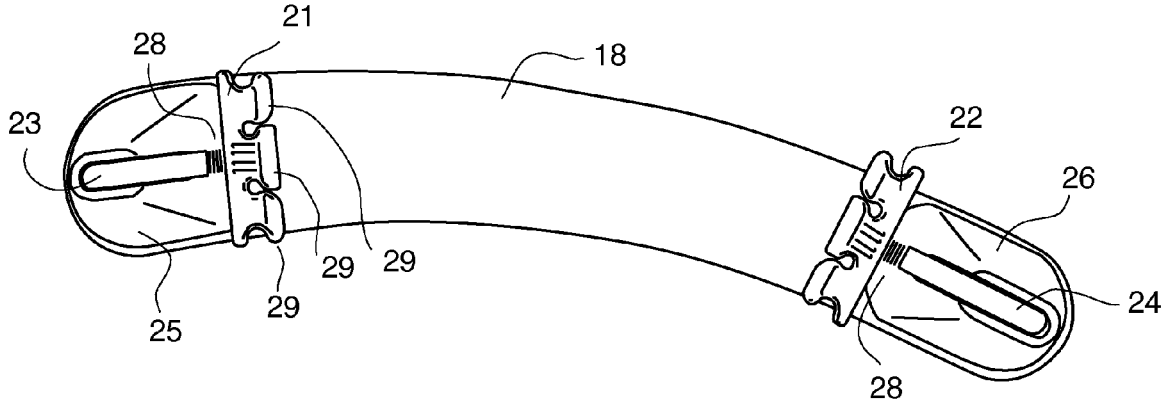
FIG. 8 is a top down perspective view of the shoulder rest showing both gripping members in a collapsed state.
Figure 11:
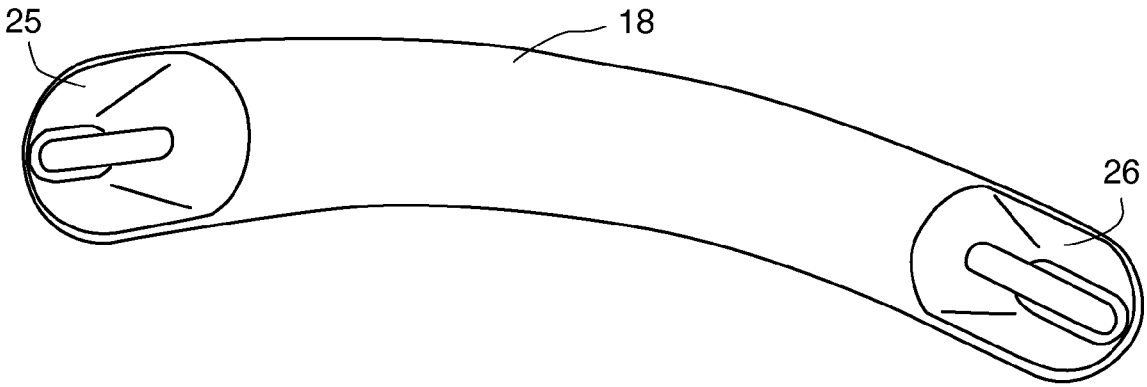
FIG. 11 is a top down perspective view of the shoulder rest showing the vertical guards without the collapsible inserts.

Turning to FIG. 5, the shoulder rest is depicted in its collapsed state with both left and right gripping members 21 and 22 being somewhat or about parallel to the top surface 18 of the elongated single piece body 17. In other words, each of the stems that are coupled to each of these two gripping members has a longitudinal axis that is substantially parallel to a longitudinal axis of the elongated single piece body 17. In another preferred embodiment, each of the two gripping members has a longitudinal axis that is substantially parallel to a longitudinal axis of the elongated single piece body 17. FIG. 6 shows a top down view of the shoulder rest with the left and right gripping members 21 and 22 at the open or un-collapsed state. FIG. 8 is another top down perspective view of the shoulder rest depicting the left and right gripping members 21 and 22 in its collapsed state. FIG. 11 depicts a top down perspective view of the shoulder rest without the left and right gripping members 21 and 22 and without the left and right collapsible inserts 23 and 24.

As clearly depicted in FIGS. 3 and 4, the left and right vertical guards prevent the left and right gripping members 21 and 22 from collapsing away from the center of the top surface 18 of the elongated single piece body 17 and generally keeps the left and right gripping members 21 and 22 to have a range of pivotal motion no larger than approximately 90 degrees between a collapsed state and an un-collapsed state.

Figure 9:
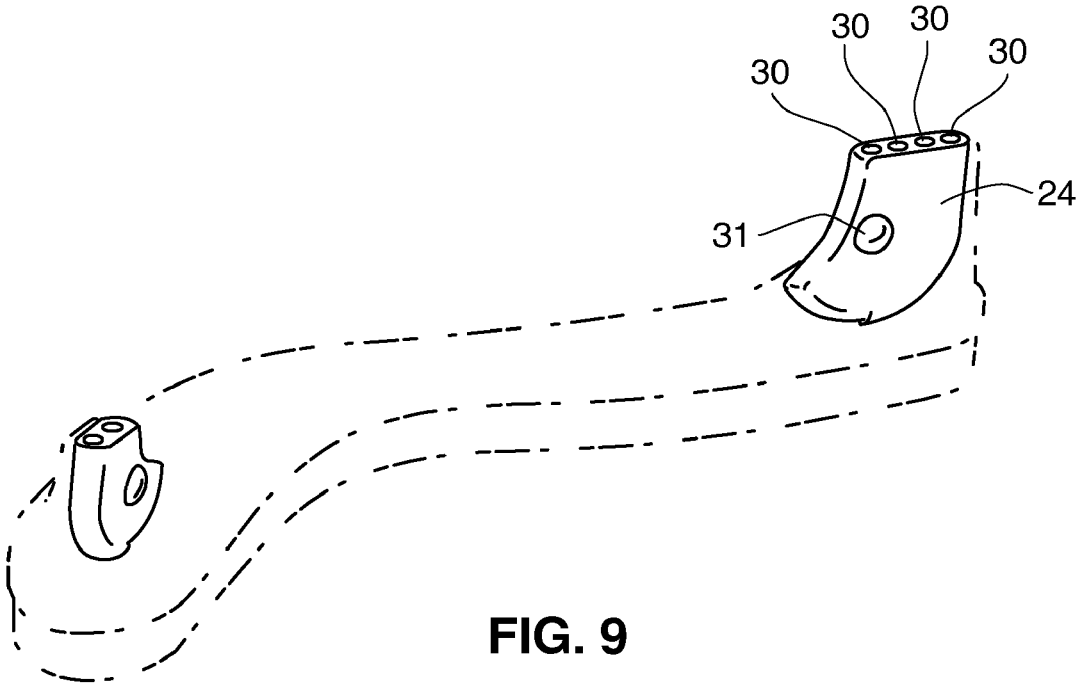
FIG. 9 is a perspective view of the right collapsible insert showing the positioning holes and the pivot point.
Figure 10:
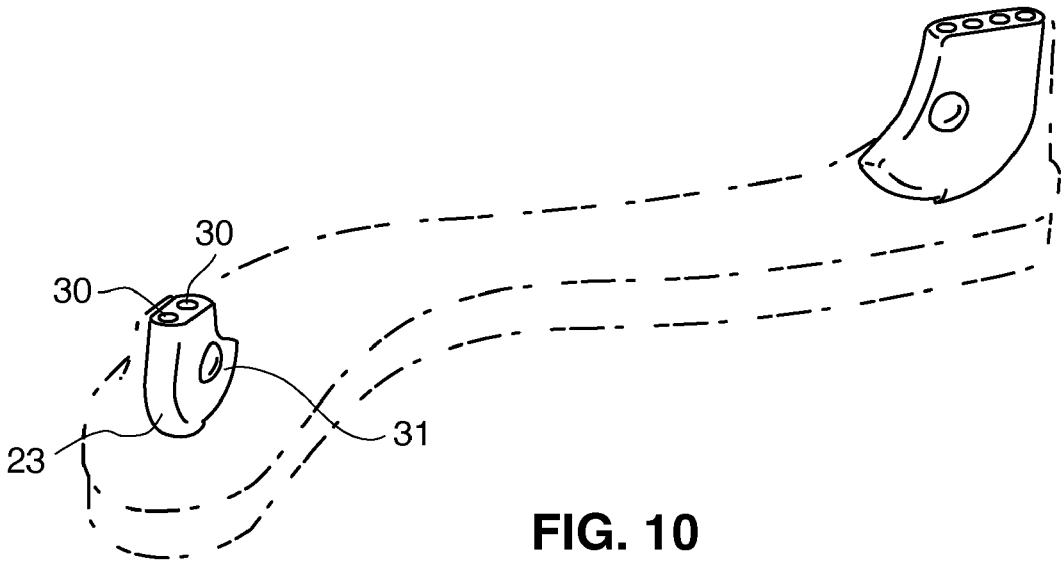
FIG. 10 is a perspective view of the left collapsible insert showing the positioning holes and the pivot point.

As best seen in FIGS. 9 and 10, the left and right collapsible inserts 23 and 24 fit securely within the interior recess of the left and right vertical guards 25 and 26. At least one pivot point or protuberance 31 being attached to the sides of the left and right collapsible inserts 23 and 24, minimizes the need for additional parts such as nuts, pins or bolts which greatly increases the complexity of manufacturing, operation and repair of the unit. This preferred arrangement also provides a pivotal joint that is hidden from the user's fingers by enclosing the pivotal joint (i.e. the pivotal point and recess) within the vertical guards 25 and 26. The relatively smooth exterior contour of the vertical guards 25 and 26 minimizes user injury that can be caused by exposed moving parts or exposed sharp component parts.

Figure 12:
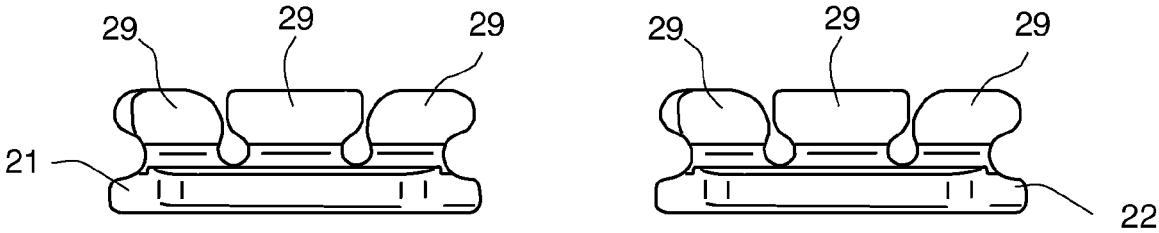
FIG. 12 is a perspective view of the front side of both gripping members.
Figure 13:
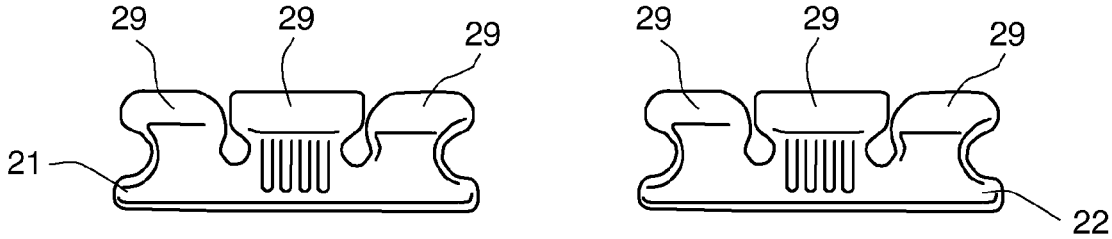
FIG. 13 is a perspective view of the back side of both gripping members.

Focusing on FIGS. 12 and 13, the gripping members are shown from the front side perspective view and from the back side perspective view. To minimize duplicity, only one gripping member is depicted since in the present embodiment, both gripping members are identical to each other, although there is no requirement that they need be in other embodiments. As clearly shown in FIGS. 12 and 13, each gripping member has a plurality of flexible separated gripping appendages 29. In the present embodiment, the gripping members have a left side appendage, a right side appendage and a center appendage. Together, the flexible separated gripping appendages 29 allow the gripping members 21 and 22 to access more surface area on the instrument body, thereby increasing stability and decreasing unwanted slippage or movement of the instrument body. In the present embodiment, the left and right appendages apply even but opposing pressure on the left and right side of the instrument body, while the center appendage applies even but opposing pressure on the top and bottom of the instrument body. In the present embodiment, the gripping members are made from a firm but flexible type of rubber material that is injection molded over the body of the gripping members 21 and 22.

Figure 14:
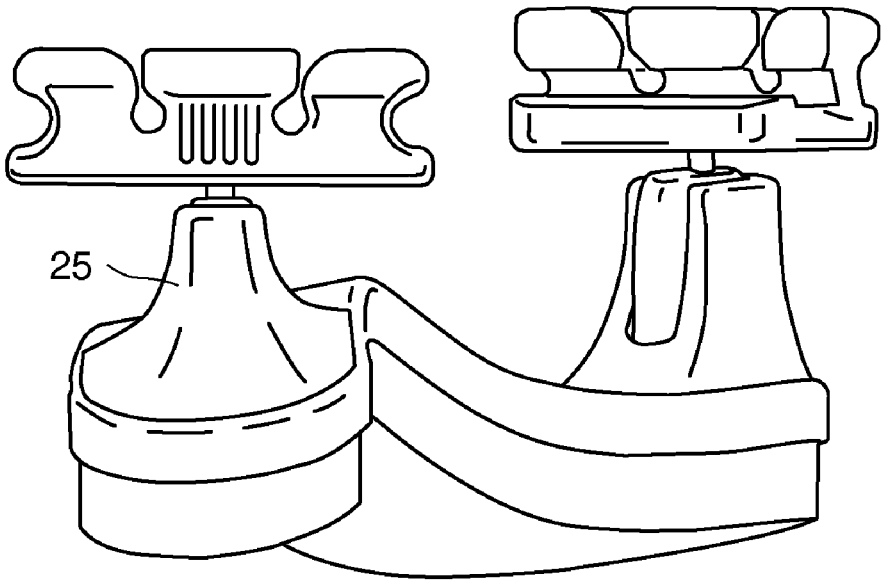
FIG. 14 is a straight ahead view of the shoulder rest from the right side.
Figure 15:
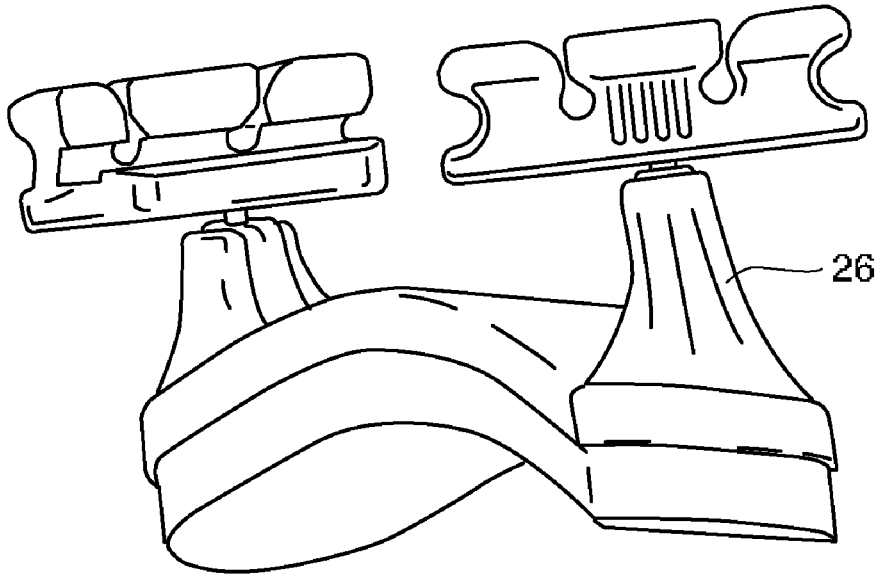
FIG. 15 is a straight ahead view of the shoulder rest from the left side.

As seen in FIGS. 14 and 15, preferred embodiments of the inventive subject matter can optionally have left and right vertical guards 25 and 26, fixedly tilted such that the range of pivotal motion of the gripping members 21 and 22, is along a plane tilted at a desired angle of between 45 to 90 degrees relative to a longitudinal planar surface of the elongated single piece body, 17, so as to improve and train the user to apply a correct playing posture.

Thus, specific embodiments and applications of the Violin Shoulder Rest have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

We claim:

1. A shoulder rest for violin or the like musical instrument, comprising:

a) an elongated single piece body having a top surface and an undersurface, a first end and a second end; said elongated single piece body extending vertically at said first end and at said second end, to form a first vertical guard and a second vertical guard;

b) said first and second vertical guards containing recesses to accept a first and second collapsible insert, respectively, each of said recesses has two internal planar walls;

c) said first collapsible insert pivotably coupled to said first vertical guard by at least one protuberance shaped pivot point; said second collapsible insert pivotably coupled to said second vertical guard by at least one protuberance shaped pivot point, each of said first and second collapsible inserts has two external planar walls that correspond with the two internal planar walls of said recesses, and said protuberance shaped pivot point is attached to one of said external planar walls of the respective collapsible insert;

d) a first gripping member having a first stem protruding from a bottom end of said first gripping member being adjustably but securely connected to a top end of said first collapsible insert;

e) a second gripping member having a second stem protruding from a bottom end of said second gripping member being adjustably but securely connected to a top end of said second collapsible insert;

f) each said pivot points adapted to allow pivotal movement of the respective collapsible insert from where a longitudinal axis of each of said first and second stems are at a generally perpendicular angle relative to a longitudinal axis of the elongated single piece body, to a position where said first and second stems are substantially parallel to said longitudinal axis of said elongated single piece body; and wherein each collapsible insert is received within a space between the two internal planar walls of each vertical guard, such that when a first stem is positioned substantially perpendicular to said longitudinal axis of said elongated single piece body, approximately 80% of the first collapsible insert is embedded within the first vertical guard.

2. The shoulder rest of claim 1, wherein both said collapsible inserts contain a plurality of positioning holes on the top ends of said collapsible inserts that provide horizontal adjustability.

3. The shoulder rest of claim 1, wherein both said vertical guards are positioned at a fixed tilted angle.

4. The shoulder rest of claim 1, wherein each said first and second gripping members comprising of a plurality of flexible separated gripping appendages.

5. A shoulder rest for violin or the like musical instrument, comprising:

a) an elongated single piece body having a top surface and an undersurface, a first end and a second end; said elongated single piece body extending vertically at said first end and at said second end, to form a first vertical guard and a second vertical guard;

b) said first and second vertical guards coupled to a first and second stem, respectively, and each of said vertical guards has a recess having two internal planar walls that receives a first and a second insert, respectively, and approximately 80% of each of the inserts is embedded within each of the recesses;

c) said first and second vertical guards are positioned at a fixed tilted angle relative to a longitudinal axis of said elongated single piece body;

d) said first stem of said first vertical guard being detachably coupled to a top end of said first inserts, and secured to a bottom end of a first gripping member;

e) said second stem of said second vertical guard being detachably coupled to a top end of second inserts, and secured to a bottom end of a second gripping member; and f) wherein said first and second gripping members are adapted to firmly but releasably grip opposing side walls of an instrument body;

g) said first insert pivotably coupled to said first vertical guard by at least one protuberance shaped pivot point; said second insert pivotably coupled to said second vertical guard by at least one protuberance shaped pivot point, each of said first and second inserts has two external planar walls that correspond with the two internal planar walls of said recesses, and said protuberance shaped pivot point is attached to one of said external planar walls of the respective insert.

6. The shoulder rest of claim 5, wherein both top ends of said first and second inserts contain a plurality of positioning holes capable of receiving said stems to provide horizontal adjustability.

7. The shoulder rest of claim 5, wherein each said first and second gripping members is comprised of a plurality of flexible separated gripping appendages.

* * * * *